US008025430B2

(12) United States Patent
Ben Natan et al.

(10) Patent No.: US 8,025,430 B2
(45) Date of Patent: Sep. 27, 2011

(54) LIGHTING DEVICE

(76) Inventors: Avner Ben Natan, New York, NY (US); Yael Erel, New York, NY (US)

( * ) Notice: Subject to any disclaimer, the term of this patent is extended or adjusted under 35 U.S.C. 154(b) by 258 days.

(21) Appl. No.: 12/410,744

(22) Filed: Mar. 25, 2009

(65) Prior Publication Data

US 2010/0014291 A1 Jan. 21, 2010

Related U.S. Application Data

(60) Provisional application No. 61/070,868, filed on Mar. 25, 2008.

(51) Int. Cl.
*F21V 7/00* (2006.01)

(52) U.S. Cl. ..... 362/322; 362/297; 362/283; 362/321

(58) Field of Classification Search ..... 362/297, 362/282–284, 322–325, 319, 269, 321
See application file for complete search history.

(56) References Cited

U.S. PATENT DOCUMENTS

| | | | | |
|---|---|---|---|---|
| 479,207 | A | 7/1892 | Edmono | |
| 549,723 | A | 11/1895 | Hitchcock | |
| 2,439,330 | A * | 4/1948 | Zander | 359/234 |
| 2,553,622 | A * | 5/1951 | Zander | 359/234 |
| 4,138,939 | A | 2/1979 | Feld | |
| 4,199,247 | A * | 4/1980 | Schwarz | 396/510 |
| 4,257,086 | A * | 3/1981 | Gulliksen | 362/279 |
| 4,458,303 | A * | 7/1984 | Berns | 362/321 |
| 5,349,898 | A | 9/1994 | Po Wo Cheung | |
| 6,422,232 | B1 | 7/2002 | Ashton | |
| 6,625,288 | B1 | 9/2003 | Koizumi | |
| 6,912,097 | B2 * | 6/2005 | Woods | 359/739 |
| 7,452,111 | B2 | 11/2008 | Mazzei | |

FOREIGN PATENT DOCUMENTS

| | | |
|---|---|---|
| EP | 1707871 | 10/2008 |
| GB | 597602 | 1/1948 |
| GB | 2407864 | 5/2005 |

OTHER PUBLICATIONS http://jasongibbs.com/portfolio/objects/steamer_lamp/ (date of publication—unknown).

* cited by examiner

*Primary Examiner* — Laura Tso

(57) ABSTRACT

A lighting device comprising a plurality of overlapping leaves hingedly attached to a base that can be manipulated to control the size of an opening through which light from a light source passes, and thereby the size and intensity of the light. In some embodiments the device includes an off-center lighting source whereby a light beam is emitted at an angle to an axis passing through the center of the opening formed by the leaves.

19 Claims, 7 Drawing Sheets

LIGHTING DEVICE

RELATED APPLICATIONS

The present invention claims priority from U.S. Provisional application 61/070,868 entitled DEVICE FOR MANIPULATING EMITTED LIGHT, filed on Mar. 25, 2008 and which is incorporated herein in its entirety.

FIELD OF THE INVENTION

The present invention relates to a lighting device, in particular a device for controlling light emitted from a light source.

BACKGROUND

The shape and intensity of light emitted from a light source is generally controlled mainly by the shape of an object in which the light source is located (e.g. a lamp shade); and that object or shade is typically static. Alternatively, the intensity of light emitted from a light source is often controlled via an electronic dimmer device. Many devices for controlling the shape and/or amount of light either emitted or received, as in the case of a camera, require an outer casing to receive the device used to control the light.

SUMMARY

The present invention relates to a device for manipulating or controlling emitted light. Specifically, the invention relates to a plurality of overlapping leaves useful for controlling and directing the light emitted from a light source.

According to exemplary embodiments of the present invention, a plurality of leaves is connected to a base, wherein the leaves are overlapping to form an opening through which light from a light source passes. Through the manipulation of the leaves, the size and/or intensity of the emitted light may be controlled, allowing a user to have direct control over the emitted light and to limit the light to a specific area. According to some aspects, the lighting device can be considered a mechanical dimming or intensity controlling device. The leaves and base can optionally be perforated to further control the emitted light by allowing light to radiate through the leaves and base.

According to particular embodiments, the light source may be offset from a center axis of the opening. This allows further manipulation of the light emitted from the opening by rotating the device (e.g. rotating the base thereof and/or a fixture or light source to which the device is attached). Adding a tilting motion to the device (e.g. via a fixture such as a lamp with a hinged stem) allows for aiming the light beam more extensively.

The base may be a ring that can be directly attached to an independent light source, allowing the manipulation of the independent light source through the opening and closing of the leaves.

BRIEF DESCRIPTION OF THE DRAWINGS

The invention may be understood upon reading of the following detailed description of non-limiting exemplary embodiments thereof, with reference to the following drawings. Identical or duplicate or equivalent or similar structures, elements, or parts that appear in more than one drawing are generally labeled with the same reference numeral. Dimensions of components and features shown in the figures are chosen for convenience or clarity of presentation and are not necessarily shown to scale or true perspective. For clarity, some structures are not shown or shown only partially, or without perspective, and duplicate or equivalent or similar parts may not be repeatedly labeled.

DETAILED DESCRIPTION OF EMBODIMENTS OF THE INVENTION

Figure 1:
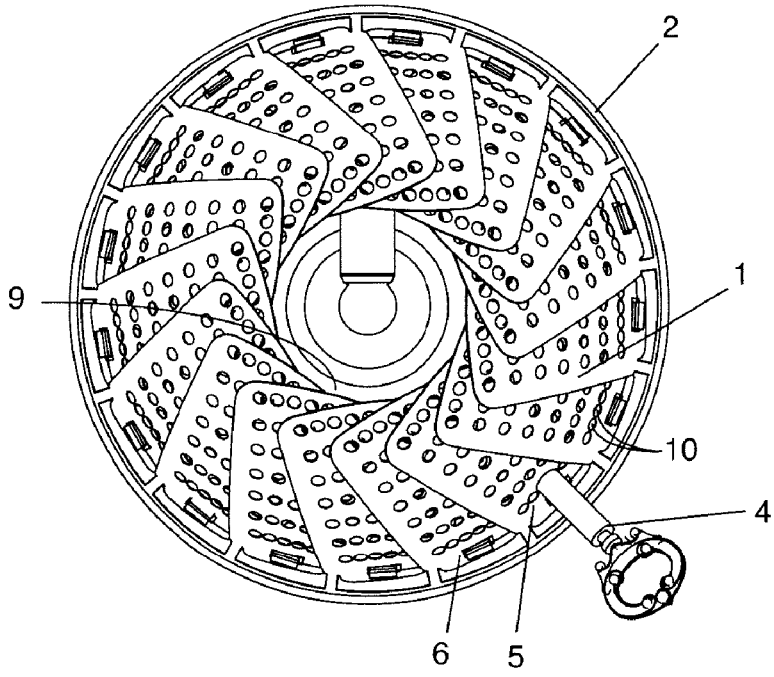
FIGS. 1 and 2 are top views of an embodiment of a lighting device according to the present invention with leaves thereof in a relatively closed position and relatively open positions, respectively.
Figure 2:
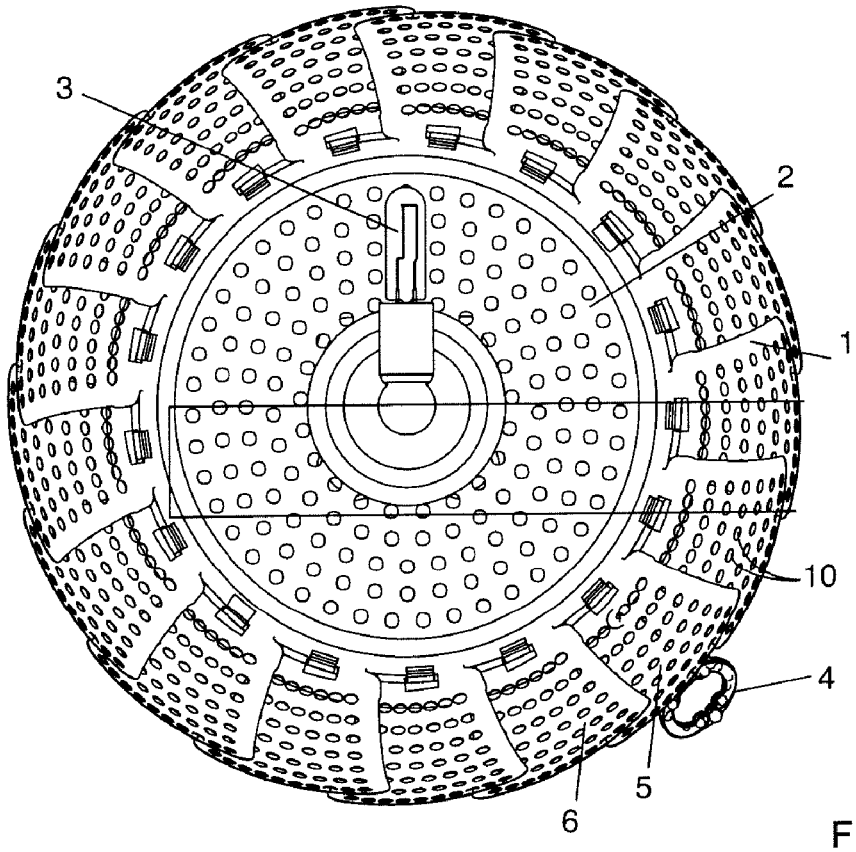
Figure 3:
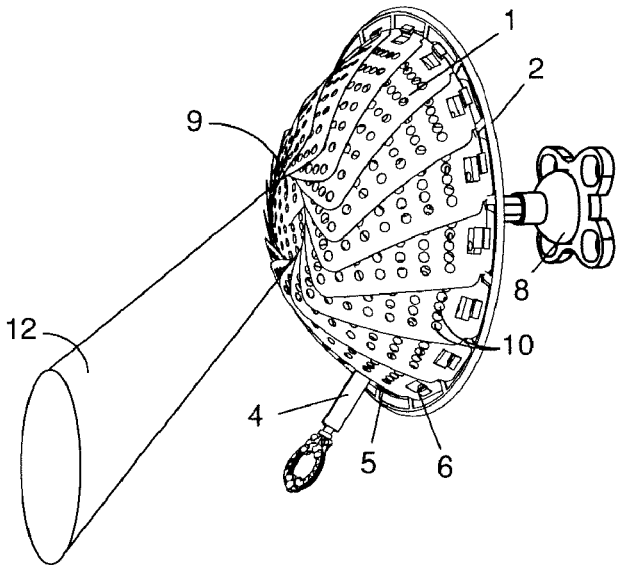
FIGS. 3 and 4 are perspective views showing the lighting device in association with a lamp, and in a relatively closed and open position, respectively.
Figure 4:
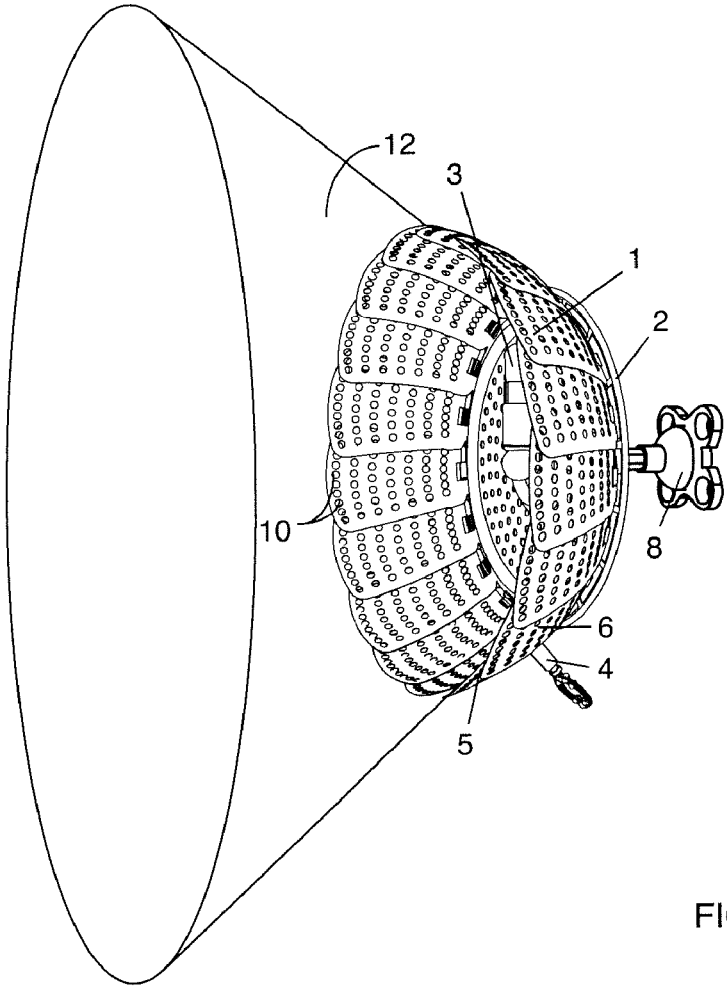
Figure 5:
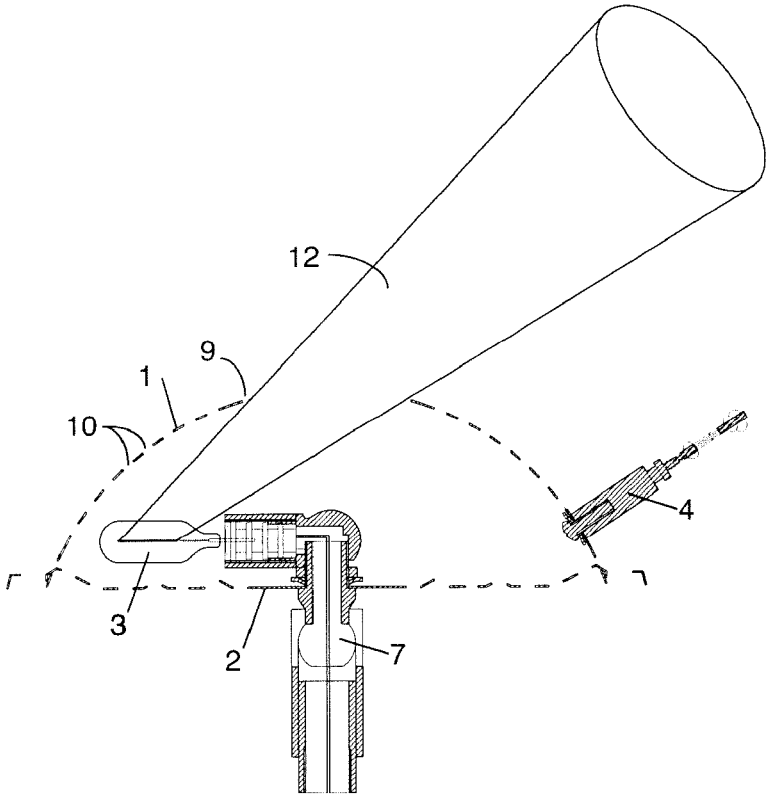
FIG. 5 is a side sectional view showing light emitted from the opening when using an offset bulb.
Figure 6:
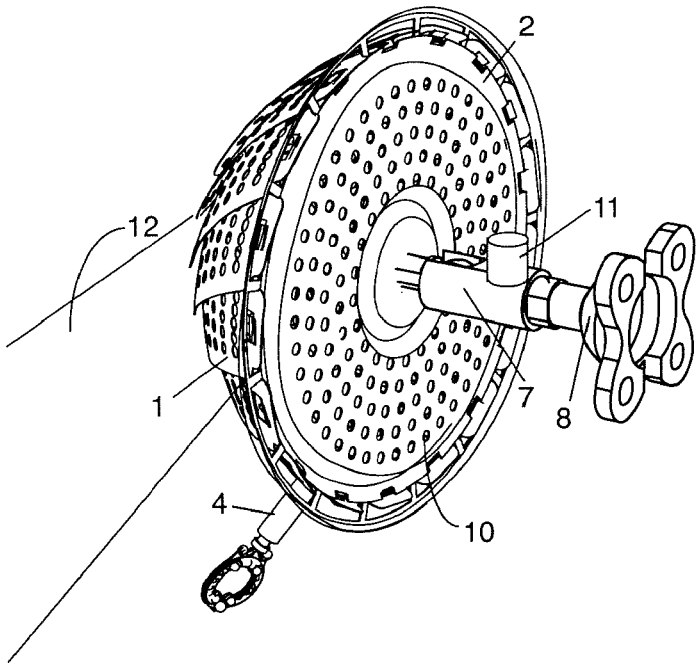
FIGS. 6 and 7 are a perspective and side view respectively of another embodiment of the lighting device adapted for automatic rotation and/or tilting of the device and illustrated as part of a rotating and tiltable fixture (lamp) in an upright and tilted position, respectively.
Figure 7:
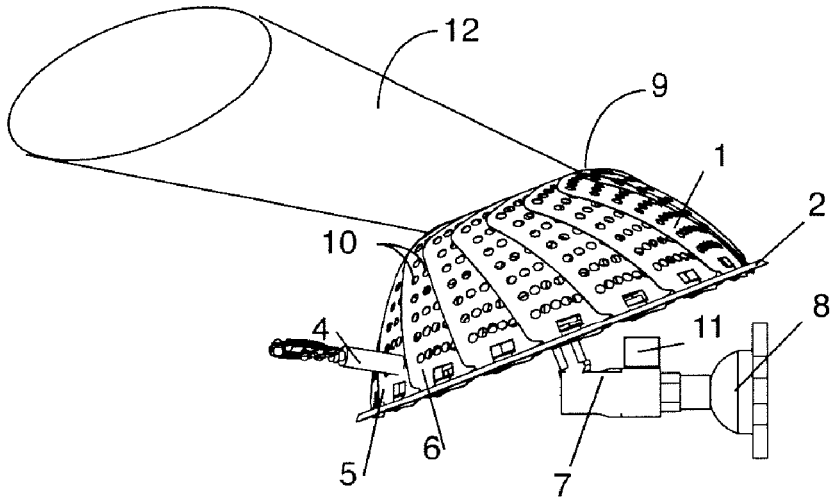
Figure 8:
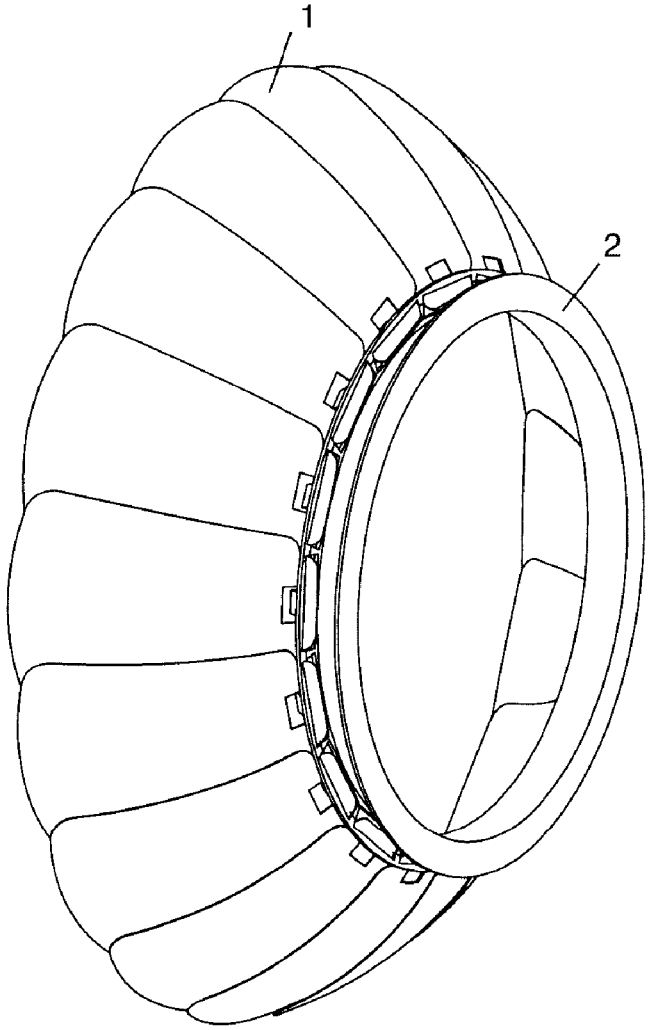
FIG. 8 is a perspective view of another embodiment of the lighting device in which a base of the device is in the form of a ring.

Referring first to FIGS. 1 and 2, there is shown an embodiment of a lighting device of the present invention comprising a plurality of overlapping leaves 1 so that a light source 3 is typically contained within the leaves 1. Each of the leaves 1 are hingedly attached to a base 2, typically at an end of the leaves 1; however, according to some embodiments, one or more of the leaves 1 are attached to the base 2 a distance along the leave(s) 1 rather than at an end thereof (FIGS. 13 and 14), so that the unattached end of the leaves 1 may be freely moved towards and away from the base 2. The base 2 is shown as flat, however the base 2 could be other shapes e.g. concave, etc.

The overlapping leaves 1 typically define an opening 9, generally at a central location with respect to the base 2, from which light from the light source 3 can pass. However, according to some embodiments, the leaves 1 can be completely closed whereby there is no substantially central opening 9. The resulting increase in the size of the opening 9 allows a correspondingly larger light beam 12 to pass through the opening 9. Additionally, by reflecting the light so that it exits through the opening 9, the design of the leaves 1 may redirect light that would otherwise be lost. The lighting device can be designed so that the opening 9 formed by the end of the leaves 1 is in a variety of shapes, for example a circle, oval, hexagon, etc.

It is noted that the lighting device is three-dimensional, in contrast, for example to the shutter of a camera. The three dimensionality of the device allows for a distance between the opening 9 and the light source 3. This distance improves the shaping of the light without requiring an outer casing that is common in a camera and in various light projectors.

According to some embodiments, some or all of the leaves 1 are perforated (FIGS. 1-7); examples of leaves 1 without perforations are depicted in FIGS. 8-15. The perforations 10 allow light to disperse through the leaves 1 which tends to decrease the intensity of the light emitting from the opening 9. The perforations 10 allow for a distinct pattern to be created on a surface. For example, circular perforations 10 can create a pattern or spot of circular or substantially elliptical light, depending on the angle at which the light hits the illuminated surface. The leaves 1 may be made of any suitable material, including metal, plastic, etc. and perforations 10 may be of any desired geometry, of any desired number, of any desired distribution on leaves 1, etc. The use of perforations 10 in some instances may be particularly suitable because the perforations 10 may reduce the heat of the device.

According to some embodiments, the base 2 also comprises perforations 10. The perforations 10 in the base 2 allow for light to disperse through the base 2 which decreases the intensity of the light emitted from the opening. Used alone or in combination with perforations 10 in the leaves 1, the perforations 10 in the base 2 can be used to control the intensity of the emitted light. The intensity of the light emitted from the opening can be partially controlled by the size and number of the perforations 10 in the base 2 and leaves 1. Perforations 10 in the base 2 also allow for a distinct pattern to be created on a surface directly behind the base 2.

According to some embodiments the leaves 1 are manually manipulated by one or more leaf closing and opening mechanisms such as leaf opening and closing actuator 4, manipulated so that the size of the opening 9 increases as the unattached ends of the leaves 1 are moved away from the center of the base 2. The leaf opening and closing actuator 4 is typically associated with a particular leaf, designated 5, and may optionally be manipulated by directly pushing or pulling the actuator 4 to thereby cause all the leaves 1 to open and close. The actuator 4 may optionally be turned whereby either a pulling or pushing force is exerted on one of the leaves 1, depending on the direction of turning, and thus on at least one adjacent leaf 6 to the leaf directly moved by the actuator 4. An exemplary mechanism is discussed further, below, with reference to FIGS. 11 and 12.

According to other embodiments, the leaf closing and opening mechanism is an automatic type mechanism (not shown), and may be controllable via a remote control unit (not shown). In a particular design, the device may comprise no leaf opening mechanism, rather the leaves 1 may be opened and closed by an outward pull and inward push, respectively by the user.

According to some embodiments, the light source 3 may be attached to the base 2 so that the light source 3 is fully contained in a volume defined by the base 2 and the leaves 1, when closed. As such, a light beam 12 can be defined by the opening 9 which changes in size as the leaves 1 are opened and closed.

The interior surfaces of the base 2 and/or the leaves 1 may optionally be coated (or polished) to modify the light emitted from the lighting device. Alternatively, the interior surface of the base 2 and/or the leaves 1 may be textured to modify the light emitted from the device. A coating and texture may be used together to further modify the light emitting from the device.

Figure 14:
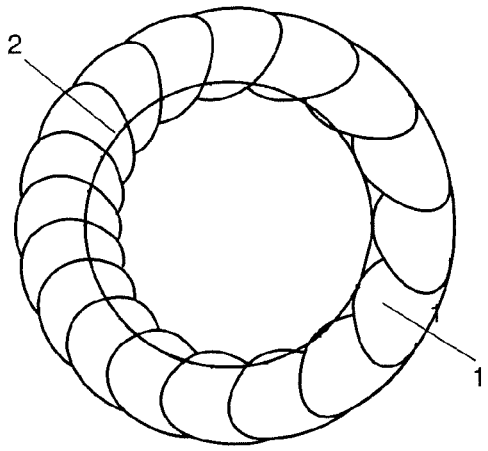
FIGS. 13 and 14 are bottom views of another embodiment of the lighting device.
Figure 13:
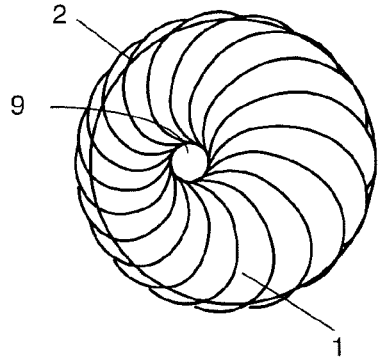
Figure 15:
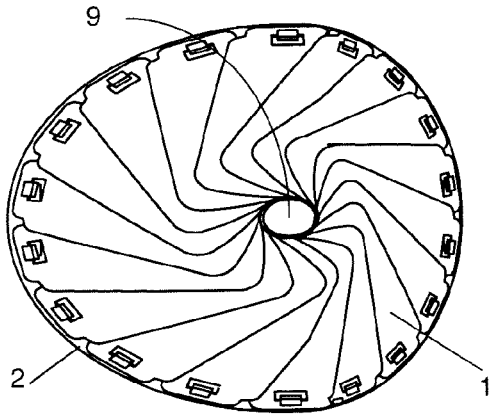
FIG. 15 is a top view of the lighting device illustrating an irregularly shaped design thereof.

With reference to FIGS. 1-7, according to some embodiments of the lighting device, the light source 3 is offset from the middle of the base 2, more specifically offset from the opening 9, so that the light source 3 is not directly below the opening. This allows a person to look directly at the opening without being subjected to direct beam of light. Furthermore, the offset light source 3 can cause the light beam 12 to leave the opening at an angle (as seen in FIGS. 3 and 5-7) which allows the beam to be positionable at a large variety of locations merely by rotating the lighting device (or a fixture to which it may be attached, for example a lamp 8; FIGS. 3-7). Rotating the lighting device can be accomplished manually or automatically, for example via a small motor 11; schematically depicted in FIGS. 6 and 7). Positioning the light beam 12 at a variety of locations can also be achieved if the light source is located centrally but the leaves are dimensioned or arranged so that the opening 9 is off-center (FIGS. 13-15). A couple of non-limiting exemplary applications for such a feature could be for a museum exhibit, a light show, a restaurant or pub, or a residential setting.

It should be noted that the lighting device is typically designed so that the light source 3 is spaced apart from the leaves 1 in order to allow for such effects as the aforementioned angled beam as well as dots produced by narrow light beams passing through the perforations 10, if any. In this regard, it should be further noted that the light source 3 is disposed completely on one side of the leaves 1, i.e. not in the opening 9, otherwise a directed light pattern (e.g. light beam 12) as intended by the lighting device could not be produced.

The base 2 can optionally be attached to a rotating member (i.e. the base 2 is rotatable or spinable), a hinged member 7 (e.g. part of the lamp 8), or a combination of the two that allows the base 2 to rotate about an axis passing through the middle of the base 2 and/or about the aforementioned hinge member 7. When used in connection with an offset light source 3, the freely moving base 2 allows the angled light beam to be manipulated so that it may be directed according to the wishes of the user. Alternatively, the light source 3 can be rotated independently of the base 2.

The base 2 can be optionally mounted so that it can be attached to a wall or ceiling, placed upright on a flat surface, or attached to an object by a clamp; or to a sky light or window 14 (discussed below), a flashlight, a theater/studio projector or a studio light 17 (FIG. 10), as well as to the lamp 8, and so on.

In some of the former exemplary applications, the lighting device is operably attached or used in combination with an artificial light source or positioned for use with a natural light source (sun, moon). In some or all of such applications, the base 2 can be constituted for example by a ring (FIGS. 8, 10, 13 and 14) allowing for the connection of the overlapping leaves 1 without preventing or impeding the passage of light. This allows for the light emitted from such artificial or natural light source to be controlled by opening and closing the leaves 1 without interference by any form of base 2 that contains material within its center (e.g. planar, concave, etc.); and thus is also useful for applications with a flashlight, studio light or spot light, and so on.

Figure 9:
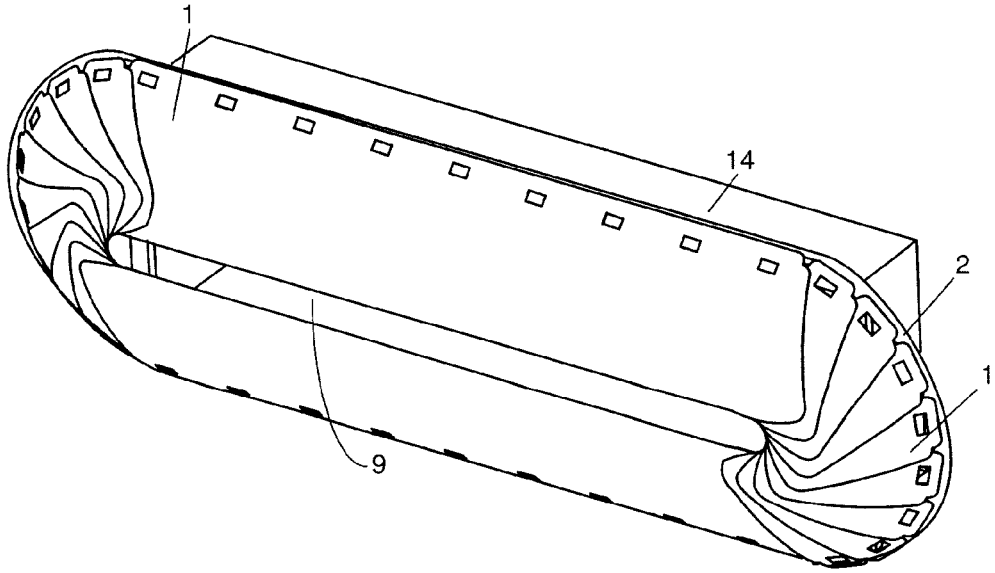
FIG. 9 is a perspective view of another embodiment of the lighting device adapted for use with a window or skylight.
Figure 10:
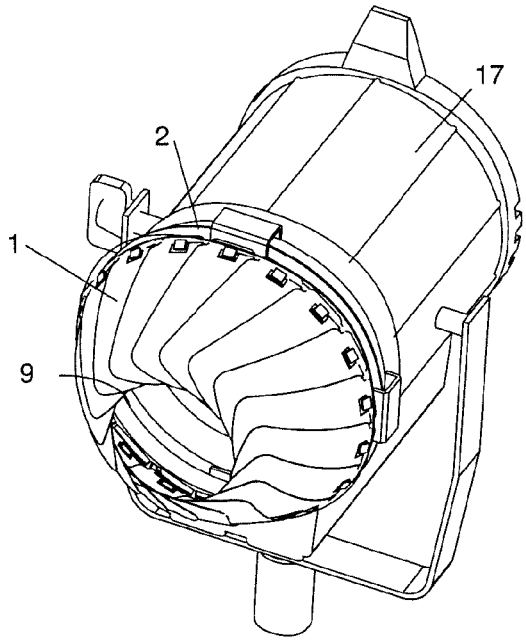
FIG. 10 is a perspective view of the lighting device illustrating use with a studio light.

Another embodiment is depicted in FIG. 9 wherein the lighting device is designed for mounting on a window 14 and for which purpose the base 2 of the lighting device is substantially rectangular; and open, i.e. constituted substantially by a ring, to allow natural light to pass through. It should be understood that in the case where natural light is the light source, the light source will not be located between the leaves 1 and the base 2. With regard to the shape of the lighting device, the device, and in particular the base 2, can be of a variety of shapes, for example square, round, egg shaped (FIG. 15), oval, and so on.

FIG. 15 also illustrates another embodiment wherein the leaves 1 are of non-uniform size thereby providing an asymmetrical lighting device and resulting in an off-centered opening 9, which could allow for aiming a light beam via rotation, while the light source remains fixed.

Figure 11:
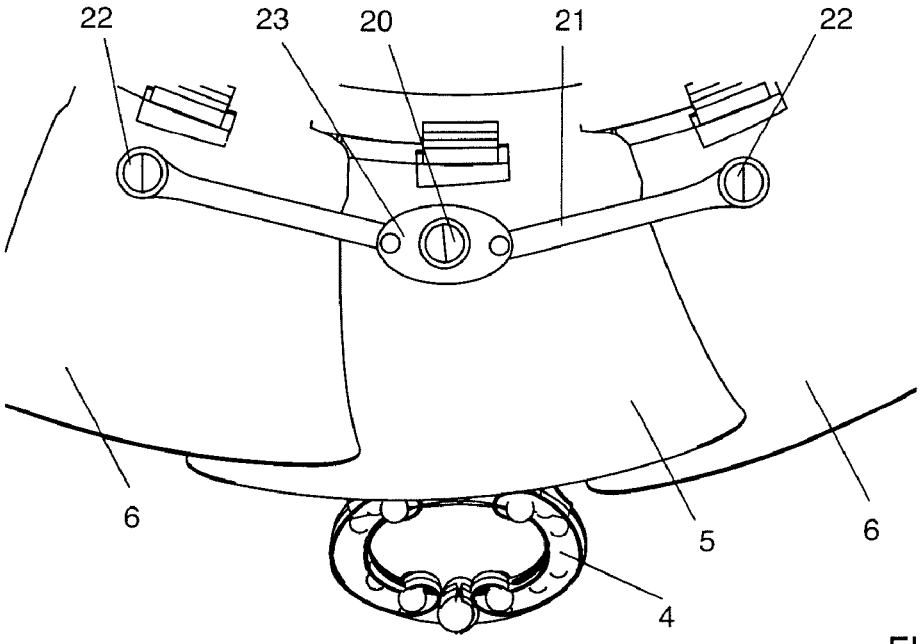
FIGS. 11 and 12 are partial bottom views illustrating an exemplary leaf opening/closing mechanism of the lighting device, in an open and closed position, respectively.
Figure 12:
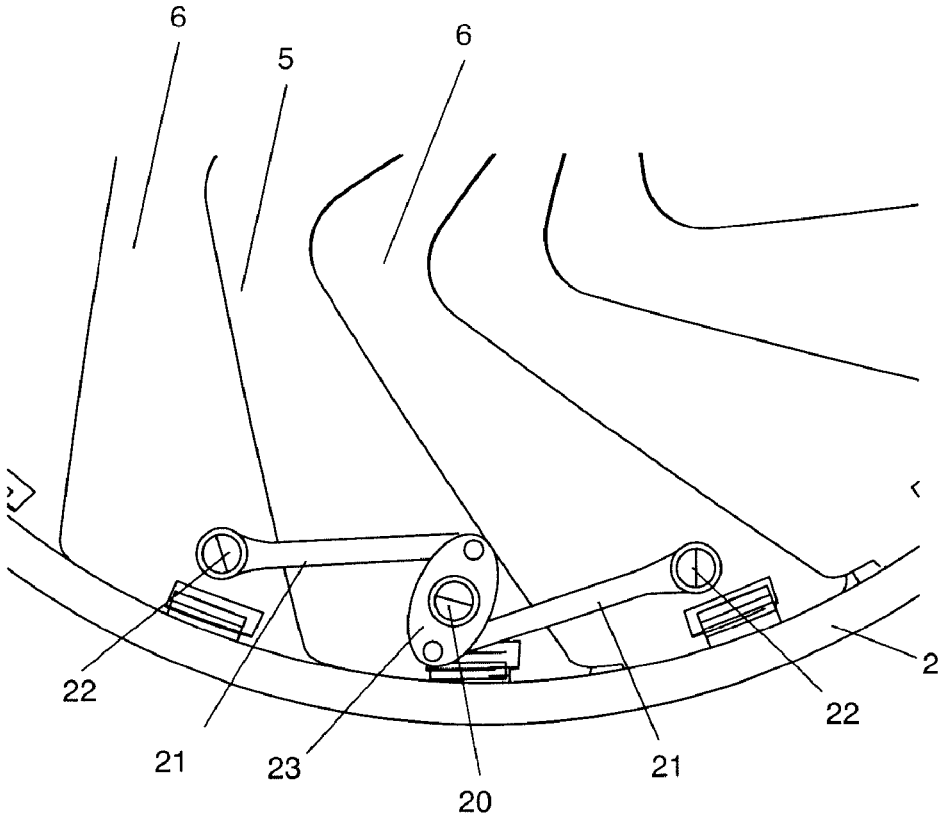

FIGS. 11 and 12 illustrate an exemplary leaf opening/closing mechanism of the lighting device, in an open and closed position, respectively. The mechanism comprises the closing actuator 4 having a free end 20 which passes through one of the leaves 5 and is attached to a cam 23. At opposite sides, the cam 23 is in turn attached to a pair of brackets 21 which are fastened to adjacent leaves 6 via a fastener 22. When the cam 23 is substantially aligned with the brackets 21 (FIG. 11), the leaves 1 are in an open configuration; whereas when the cam 23 is turned by the actuator 4 so the cam 23 is not aligned, in particular perpendicular to the brackets 21, the leaves 1 are pulled together in a closed configuration. Turning the actuator 4 back to the aligned position (cam 23 aligned with the brackets 21) pushes the adjacent leaves 6 (adjacent to leaf 5) away from each other thereby opening the leaves 1.

FIGS. 13 and 14 depict another embodiment of the lighting device wherein the base 2 is in the form of a ring and the leaves 1 are not all attached to the ring at their ends, rather some of the leaves 1 are attached part way along (in particular as seen in the left side of FIGS. 13 and 14). Such a design results in an off-centered opening, which as mentioned above achieves an angled light beam 12 even if the light source 3 is centrally located.

FIG. 15 illustrates an irregularly shaped design of the lighting fixture, specifically an egg-shaped design. Also depicted is an exemplary design wherein the leaves 1 are of different sizes. Again, such a design results in an off-centered opening, which achieves an angled light beam 12 even if the light source 3 is centrally located.

The light source 3 may optionally be controlled by a standard switch, a dimmer, a touch dimmer, etc. (not shown). If a touch dimmer is used, the light source 3 can be controlled by touching any part of the base 2 or leaves 1 that is made of metal. Additionally, if the base 2 is optionally mounted on a metal support, the touch dimmer can be activated by touching the metal support, and further if the metal support is in direct contact with a metal structure such as a table or chair frame, the touch dimmer can be activated by touching the metal structure.

The light source 3 may be a bulb containing xelogen gas. This type of bulb is specifically used to generate less heat than a halogen bulb. This type of bulb may be particularly suitable because it is less likely to explode at the end of its life allowing for little or no shielding of the bulb to be required. This type of bulb may also be particularly suitable because it does not emit damaging ultraviolet light and therefore does not require ultraviolet light shielding.

Thus, according to at least some embodiments, the invention provides a lighting device comprising an adjustable uniform opening from which light is emitted and can result in an non-uniform distribution of light or angled light emission.

The arrangements described above allow for a variety of uses and applications that will be appreciated by one skilled in the art. For example, the device can be used for applications requiring a light beam of both a particular size and intensity and applications benefitting from an adjustable light beam (e.g. illuminating art work of varying sizes). In another example, the device can be used to create a specific pattern or effect of light on surface. Although the present invention has been described with reference to particular examples and embodiments, it should be understood that the present invention is not limited to those examples and embodiments. Moreover, the features of the particular examples and embodiments may be used in any combination. The present invention therefore includes variations from the various examples and embodiments described herein, as will be apparent to one of skill in the art.

The invention claimed is:

1. A lighting device for use in combination with a light source, the device comprising:

a plurality of overlapping concave leaves defining an opening through which light from the light source can be emitted; and a base at which said leaves are hingedly attached, whereby movement of one or more of the plurality of overlapping leaves produces a corresponding movement, opening or closing, of the remainder of the leaves, whereby the opening defined by the leaves is enlargeable and can be contracted and wherein at least said base or one of said plurality of overlapping concave leaves comprises perforations for controlling the emitted light by allowing light to radiate there-through.

2. A device according to claim 1, further comprising a mechanism for moving the leaves to and away from the base whereby the opening defined by the leaves is enlargeable and can be contracted.

3. A device according to claim 2, wherein the mechanism for moving the leaves is manually actuated.

4. A device according to claim 2, wherein the mechanism for moving the leaves is automatically actuated.

5. A device according to claim 1, wherein the light source is offset with respect to the opening defined by the leaves.

6. A device according to claim 1, wherein the light source is an artificial light source.

7. A device according to claim 1, wherein the light source is a natural light source.

8. A device according to claim 1, wherein the base is constituted by a concave ring.

9. A device according to claim 1, wherein the base or light source is rotatable.

10. A lighting fixture comprising:

a light source;

a plurality of concave overlapping leaves defining an opening through which light from the light source can be emitted; and a base at which said leaves are hingedly attached, at least said base or one of said plurality of overlapping concave leaves comprising perforations for controlling the emitted light by allowing light to radiate there-through.

11. A fixture according to claim 10, further comprising a mechanism for moving the leaves to and away from the base whereby the opening defined by the leaves is enlargeable and can be contracted.

12. A fixture according to claim 10, wherein the light source is offset with respect to the opening defined by the leaves.

13. A fixture according to claim 10, wherein the base is constituted by a ring.

14. A fixture according to claim 10, wherein the mechanism for moving the leaves is manually actuated.

15. A fixture according to claim 10, wherein the mechanism for moving the leaves is automatically actuated.

16. A fixture according to claim 10, wherein the base is rotatable.

17. A method of controlling the size or intensity of light emitted from a light source comprising: moving at least one of a plurality of overlapping concave leaves hingedly arranged on a base whereby an opening defined by the leaves is enlargeable and can be contracted and at least said base or one of said plurality of overlapping concave leaves comprises perforations for controlling the emitted light by allowing light to radiate there-through.

18. A device according to claim 1, wherein the leaves have an interior surface that are coated or polished to modify the light emitted.

19. A fixture according to claim 10, wherein the leaves have an interior surface that are coated or polished to modify the light emitted.

* * * * *